United States Patent [19]

Job

[11] 4,109,727

[45] Aug. 29, 1978

[54] DUAL-SEAL SPRINKLER SYSTEM

[76] Inventor: Eduard J. Job, Schimmelmannstrasse 25, 2070 Ahrensburg b., Hamburg, Germany

[21] Appl. No.: 718,401

[22] Filed: Aug. 30, 1976

[30] Foreign Application Priority Data

Sep. 6, 1975 [DE] Fed. Rep. of Germany ..... 2539703

[51] Int. Cl.[2] ..... A62C 37/14

[52] U.S. Cl. ..... 169/41; 277/226; 277/228

[58] Field of Search ..... 169/37, 38, 39, 40, 169/41; 277/228, 233, 34, 34.3, 226; 220/378

[56] References Cited

U.S. PATENT DOCUMENTS

| | | | |
|---|---|---|---|
| 793,357 | 6/1906 | Diederici | 169/38 |
| 793,821 | 7/1905 | Cass, Jr. | 169/40 |
| 842,725 | 1/1907 | Taylor | 169/38 |
| 1,733,701 | 10/1929 | Taylor | 169/38 |
| 1,797,919 | 3/1931 | Loepsinger | 169/38 |
| 2,085,987 | 7/1937 | Loepsinger | 29/157.1 R |
| 2,324,170 | 7/1943 | Ofstie | 169/39 |
| 2,378,273 | 6/1945 | Wilhelm | 169/38 |
| 2,661,805 | 12/1953 | Lim | 169/41 |
| 2,859,061 | 11/1958 | Reid | 277/228 |
| 2,893,060 | 7/1959 | Wills | 277/34.3 X |
| 3,007,528 | 11/1961 | Gloeckler | 169/41 |
| 3,080,000 | 3/1963 | Gloeckler | 169/37 |
| 3,171,935 | 3/1965 | Gloeckler | 337/409 |
| 3,253,657 | 5/1966 | Job | 169/38 |
| 3,273,743 | 9/1966 | McColl | 277/233 X |
| 3,385,604 | 5/1968 | Traufler | 277/34.3 X |
| 3,446,286 | 5/1969 | Kreidler | 169/26 |
| 3,618,814 | 11/1971 | Nagroski | 220/378 X |
| 3,625,289 | 12/1971 | Gloeckler | 169/39 |
| 3,633,676 | 1/1972 | Gloeckler | 169/40 |
| 3,635,370 | 1/1972 | Romanauskas | 220/378 X |
| 3,714,989 | 2/1973 | Gloeckler | 169/19 |
| 3,715,700 | 2/1973 | Gloeckler | 337/407 |
| 3,812,915 | 5/1974 | Livingston | 169/38 |
| 3,874,456 | 4/1975 | Gloeckler | 169/39 |

FOREIGN PATENT DOCUMENTS

| | | | |
|---|---|---|---|
| 1,408,571 | 7/1965 | France | 169/41 |
| 954,967 | 4/1964 | United Kingdom | 169/41 |
| 1,118,526 | 7/1968 | United Kingdom | 169/38 |
| 1,349,935 | 4/1974 | United Kingdom | 169/37 |

*Primary Examiner*—Robert R. Song
*Assistant Examiner*—Michael Mar
*Attorney, Agent, or Firm*—H. Dale Palmatier

[57] ABSTRACT

A sprinkler comprising a frame formed at one portion with a passage terminating at a seat, a closure disposed across the passage adjacent the seat, a seal having a pressure-impacted side and another side exposed to ambient pressure and being disposed between the closure and the seat, and a heat sensitive rupturable part disposed between another portion of the frame and the closure so as to hold the closure so disposed when the rupturable part is at ambient temperature and adapted to release the closure and the seal when the part is at elevated temperature, wherein the seal comprises a first sealing member disposed against the seat and a second sealing member disposed between a portion of the closure and the first sealing member, the second sealing member pressing the first sealing member against the seat and being covered by the first sealing member on the pressure-impacted side.

7 Claims, 3 Drawing Figures

DUAL-SEAL SPRINKLER SYSTEM

CLAIM OF PRIORITY

Priority is claimed under 356 U.S.C. 119 for an application filed in the Federal Republic of Germany, Ser. No. P 25 39 703.9, Sept. 6, 1975.

BACKGROUND OF THE INVENTION

1. Field of the Invention

This invention relates to a fire extinguishing sprinkler activated by a temperature responsive destructable or yieldable detector, which maintains a closure in position to contain a fire extinguishing fluid, and in particular to an improved means of providing a long-lasting seal to contain the fluid.

2. Prior Art

Many attempts have already been made to provide permanent seals for sprinklers which are activated by temperature responsive destructable or yieldable devices. Generally, elastic materials have been used to provide sealings or packings, since these materials possess the favorable physical characteristics to provide a good seal. However, the normal temperature range of operation for such sprinklers is from 50° to 250° C. (112°–482° F.) and since not only water but also other extinguishing fluids may be used, such seals encounter a variety of chemical conditions. In addition, sprinkler systems when installed must remain operational for a number of years. And it has been observed that even the best elastic materials tend to disintegrate or loose their proper sealing qualities with time. Users of sprinklers find such leaks intolerable since damage to equipment can occur. Moreover, the adverse physical or chemical conditions can accelerate the deleterious effects so that proper sealing can no longer be achieved.

Many known materials of the prior art exhibit the loss of their sealing qualities by becoming tacky so that they would tend to stick to the seat and thus prevent the desired activation of the sprinkler at a time when it would be called on to function. Therefore many materials, after having been exposed to adverse temperature and chemical conditions, cannot provide the necessary disengagement when the predetermined temperature is reached and thus such materials may precipitate a possible failure of the sprinkler.

The choice of even very expensive materials such as fluoro-elastimers, silicone rubber, and the like, does not eliminate these problems since even these materials are not impervious to water or steam for prolonged periods of time, especially when exposed to higher temperatures. Sprinkler seals which contain these materials in contact with water or moist air under pressure at higher temperatures exhibit speeded deterioration.

SUMMARY OF THE INVENTION

It is an object of this invention to provide a sprinkler which is activated at a predetermined temperature and includes an improved seal to prevent leakage of a high pressure fire extinguishing fluid.

It is an additional object of this invention to provide a fire extinguishing sprinkler system seal which will not deteriorate under prolonged exposure to adverse physical and chemical conditions yet remain elastic to allow proper disengagement when the sprinkler is activated.

These and other objects, features, and advantages of this invention may be attained in a sprinkler comprising a frame with a passage terminating at a seat and having a closure disposed across the passage, a seal having a pressure-impacted side and an ambient pressure side is disposed between the closure and the seat, means attached to another portion of the frame to hold the closure against the seal thus to prevent fluid on the pressure side from passing through the passage, and is adapted to release the closure and the seal when the surrounding temperature has been elevated to some predetermined level, and a seal comprising a first sealing member disposed against the seat and a second sealing member disposed between the closure and the first sealing member, the second sealing member pressing the first sealing member against the seat and being covered by the first sealing member on the pressure-impacted side.

DESCRIPTION OF THE PREFERRED EMBODIMENT

Figure 1:
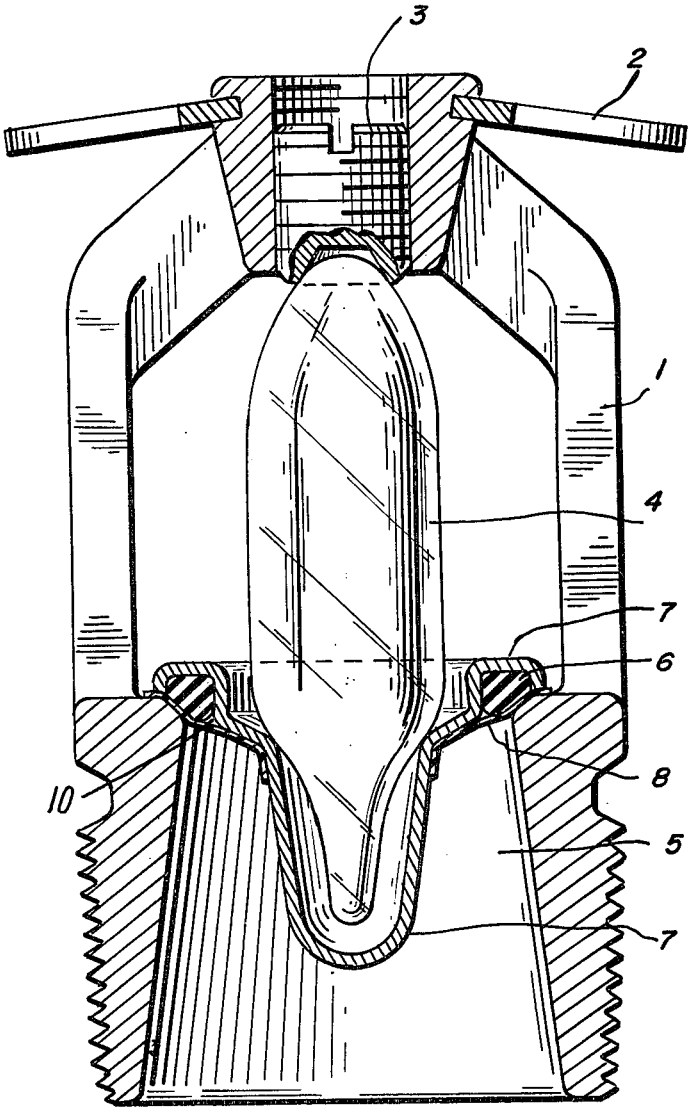
FIG. 1 is a sectional view of an embodiment of the invention, showing the destructable glass ampoule holding the closure in position with the two member seal positioned against the seat.

FIG. 1 shows a cross sectional view of a sprinkler head body which incorporates the invention. The sprinkler head body comprises a frame 1 which has a passage 5 terminating at a seat. The seat end of the frame is threaded to allow screw mounting to a source of fire extinguishing fluid. Passage or region 5 represents the pressure impacted side of the sprinkler and defines that region containing a fluid, moist air under pressure or a gas for extinguishing a fire. On the ambient side of the sprinkler, there is included a distribution plate 2 for directing the flow of emerging water or other fire extinguishing fluid in a desired manner. This is normally made of metal, attached to frame 1, and consists of an array of petals or some other geometric design to achieve the proper distribution.

Also on the ambient side of the frame is an adjustable screw 3, which holds a glass ampoule 4 in position. The glass ampoule is in compressional contact between a metallic closure 7 and the adjustable screw 3. It may be appreciated that several forms of thermally responsive devices may be used to keep the metalic closure 7 against the seat of the frame and yet will respond by releasing the closure at an elevated temperature. In the preferred embodiment, a thin-walled glass ampoule filled with an expandable liquid has been chosen as the thermally responsive element. Threaded screw 3 may be adjusted to position the glass ampoule 4 against closure 7 and may be advanced to provide the necessary pressure to maintain the integrity of the seal to prevent any leaking. As the temperature is elevated, the liquid contained in glass ampoule 4 expands causing the glass-envelope to break, thus releasing the closure and allowing the fire extinguishing fluid to flow through the passage. In the preferred embodiment, glass ampoule 4 comprises the means which is disposed between the frame and the closure to hold the closure in position.

Closure 7 may consist of a formed metal plate or other suitable material, as shown in FIG. 1 to provide closure against the seat on the pressure-impacted side of the passage. The seal is positioned to contact the frame at the shoulder portion of the seat as shown in FIG. 1. The seal consists of two members: as illustrated, a first member 8 is a thin imperforate membrane of plastic sheet-like film material impervious to the deteriorating effects of the fluid in the passage 5. Membrane 8 is in contact with closure 7 and in direct contact with the seat shoulder portion of the frame. The second sealing member 6 comprises an elastic material in contact with the first sealing material and held in position by a flange portion of the metal closure 7. In sequence metal closure 7 contacts the second sealing member 6, which contacts the first sealing member 8, which contacts with the valve seat, thus providing the closure.

The problem is to provide a seal for the sprinkler system which will not disintegrate over a long period of time nor under adverse physical and chemical conditions. This problem is resolved by the present invention by providing a seal consisting of two members. The first member is shown in the form of an annular ring, although it may be appreciated that many variations in geometry will suffice, which is in direct contact with the fire extinguishing fluid. This first member is in contact with metal closure 7 and extends to and rests on the shoulder of the seat of frame 1. The material is chosen so as to be impervious to adverse physical and chemical conditions in the pressure impacted region. An example of such material would be polytetrafluorethylene. It is well known, however, that polytetrafluorethylene exhibits the phenomenon of cold creep and therefore this material by itself cannot provide an adequate seal. The second member of the seal is protected against the pressure impacted side by the first member and is held in position by the flange of metal closure 7. Through the additional application of the first sealing member 8 which is impervious to the adverse conditions, the second sealing member 6 is protected effectively against such conditions. This protection can be assured for long periods of time extending into years. On the ambiant side, the sealing member 6 retains its elastic qualities so that the advantages of the choice of the ordinary elastic materials may be realized. For example, the normal O-ring type sealing may be utilized in this case since the accelerated deterioration of the material due to the adverse conditions will no longer occur. Slight irregularities in the area of the valve seat can be ignored because both sealing members are deformable and the pressure of the closure is transferred to the seal to provide a secure fluid barrier.

As shown the second sealing member is completely covered from the ambient conditions. As an alternative design, metal closure 7 can have a flange which is vented by a series of holes or slots open to the ambient environment if no chemical attack on the material is expected. In operation at an elevated temperature the glass ampoule 4, or fusible temperature detector 4*a* as shown in subsequent figures, is destroyed through the effect of the heat. At this temperature parts numbered 6, 7 and 8, comprising the metal closure and the two member seal, are detached from the seat of frame 1 and the extinguishing fluid or gas mixture emerges from the passage without hindrance. The emerging fluid is then directed by distribution plate 2 to extinguish the fire. However, as long as the glass ampoule or temperature detection device is held in place, the two part sealing member provides an adequate leak-proof seal with the second sealing member being protected from the adverse physical and chemical conditions of the pressure impacted region. In an advantageous manner the interstitial space defined by and between the closure, first sealing member and second sealing member may also be filled with an inert fluid.

In subsequent figures identical reference numbers refer to identically functioning parts or devices, although some alternative design variations may be incorporated.

Figure 2:
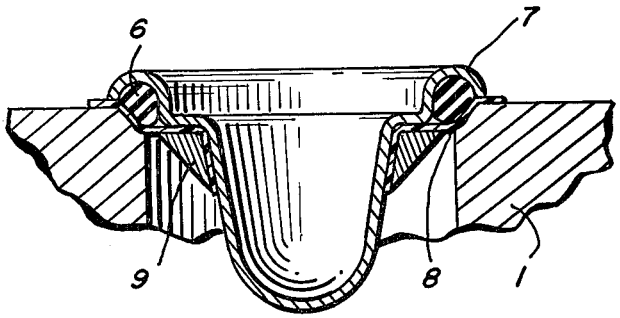
FIG. 2 shows an alternative to the embodiment shown in FIG. 1 with the addition of a clamping ring on the closure to secure the first member of the seal to the closure.

FIG. 2 shows an alternative embodiment having a different geometric arrangement of the closure and sealing elements shown in FIG. 1. Closure 7 is shown to have a circular cross sectional flange such as might be appropriate for the use of an O-ring as the second sealing member 6. The first sealing member 8 is held in position as before but with the addition of a clamping ring 9 provided to retain the first closing member 8 in position against closure 7. It may be appreciated that several variations in geometry and arrangement of the elements comprising the preferred embodiment may be made without affecting the intended scope of the invention.

Figure 3:
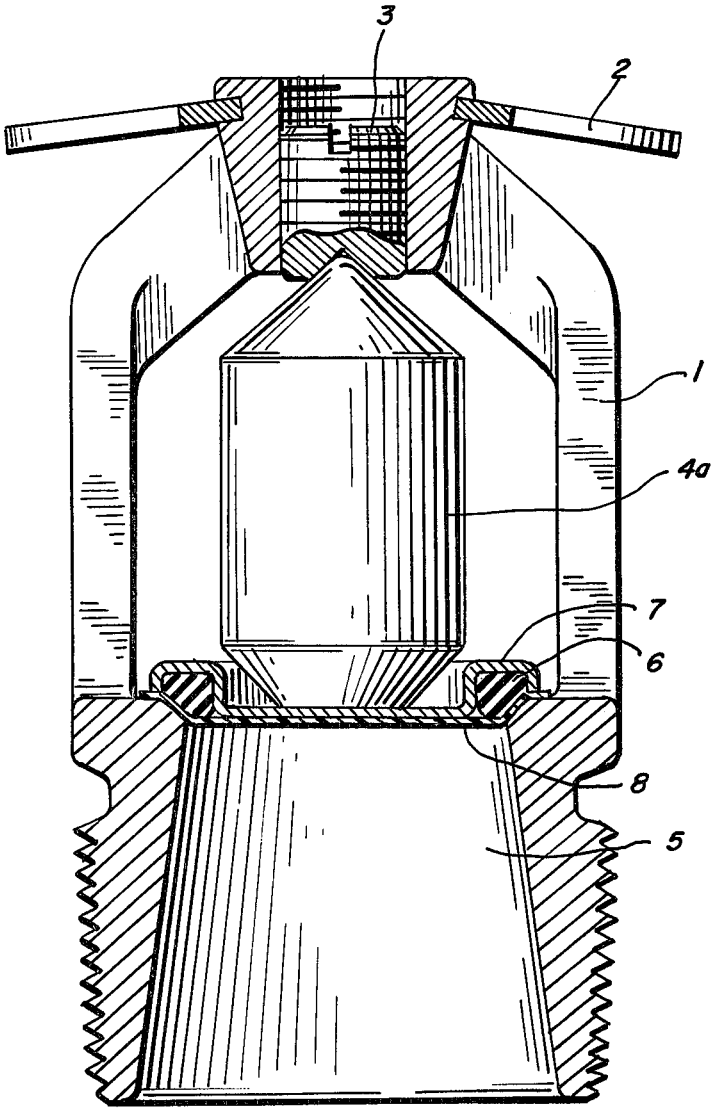
FIG. 3 is a sectional view of a second alternative embodiment of the invention, showing a fusible thermal detector in the position of the glass ampoule of FIG. 1, along with a change in the geometry of the closure and first seal member.

FIG. 3 shows an additional preferred embodiment. The liquid filled glass ampoule 4 is now been replaced by a fusable thermal detector 4*a*. In this case, the fusable thermal detector is held in compression between adjustable screw 3 and closure 7. With elevated temperature the material in fusable detector 4*a* melts thus allowing the pressure on the pressure impact side of the passageway to disengage the closure and seal and allow free passage of the fire extinguishing fluid.

In FIG. 3 both closure 7 and first sealing member 8 have different shapes than in FIG. 1. For this embodiment metallic closure 7 is disc shaped but with the original flange design to provide a containment for second sealing member 6. Correspondingly, first sealing member 8 is made in the form of a disc to cover the entire passageway and still provide protection for the second sealing member, which is again shown in the form of an annular ring. In operation all of the parts function as discribed earlier with similarly reference numbered parts providing identical function.

I claim:

1. In a sprinkler comprising a frame formed at one portion with a fluid passage terminating at an annular seat, a closure disposed across said passage adjacent said seat, an annular seal having a pressure-impacted side and another side exposed to ambient pressure and being disposed between said closure and said seat, and means disposed between another portion of said frame and said closure so as to hold said closure with said seal when said means is at ambient temperature and adapted to release said closure and said seal when said means is at elevated temperature, an improvement wherein said seal comprises a sealing membrane of deformable sheet-like film material and having its periphery lying against said seat and also having an annular portion adjacent the periphery trasversing a portion of the passage and lying against the closure, and a compressibly elastic sealing ring disposed between a portion of said closure and the periphery of said sealing membrane, the closure bearing against said elastic sealing ring which resiliently presses the periphery of said annular sealing membrane against said seat to require the film material of the membrane to conform to the contour of the seat and seal thereagainst, said sealing membrane forming the pressure-impacted side of the seal and the annular portion of the membrane also traversing the elastic sealing ring and isolating the ring from the passage and the fluid therein.

2. The improvement of claim 1 wherein said first sealing membrane is formed from an annulus of plastic material.

3. The improvement of claim 1 wherein said sealing membrane is formed from a disc of plastic material.

4. The improvement of claim 1 wherein said closure, sealing membrane, and said sealing ring define an interstitial space filled with inert fluid.

5. In a sprinkler comprising a frame formed at one portion with a passage terminating at a seat, a closure disposed across said passage adjacent said seat, a seal having a pressure-impacted side and another side exposed to ambient pressure and being disposed between said closure and said seat, and means disposed between another portion of said frame and said closure so as to hold said closure with said seal and when said means is at ambient temperature and adapted to release said closure and said seal when said means is at elevated temperature, an improvement wherein said seal comprises a first sealing member of deformable sheet-like material and disposed against said seat and a second elastic sealing member disposed between a portion of said closure and said first sealing member, said second sealing member resiliently pressing said first sealing member against said seat and being covered by said first sealing member on the pressure-impacted side, and a clamp being mounted to hold said first sealing member on said closure.

6. In a sprinkler comprising a frame formed at one portion with a passage terminating at a seat, a closure disposed across said passage adjacent said seat, a seal having a pressure-impacted side and another side exposed to ambient pressure and being disposed between said closure and said seat, and means disposed between another portion of said frame and said closure so as to hold said closure with said seal when said means is at ambient temperature and adapted to release said closure and said seal when said means is at elevated temperature, an improvement wherein said seal comprises a first sealing member of deformable sheet-like material and disposed against said seat and a second elastic sealing member disposed between a portion of said closure and said first sealing member, said second sealing member resiliently pressing said first sealing member against said seat and being covered by said first sealing member on the pressure-impacted side, said second annular member being a ring formed of elastic material, said first sealing member being formed of an annulus of plastic material, and the closure having a grooved annular flange confining the second elastic sealing member from ambient conditions to minimize the deterioration thereof.

7. In a sprinkler comprising a frame formed at one portion with a passage terminating at a seat, a closure disposed across said passage adjacent said seat, a seal having a pressure-impacted side and another side exposed to ambient pressure and being disposed between said closure and said seat, and means disposed between another portion of said frame and said closure so as to hold said closure with said seal when said means is at ambient temperature and adapted to release said closure and said seal when said means is at elevated temperature, an improvement wherein said seal comprises a first sealing member of deformable sheet-like material and disposed against said seat and a second elastic sealing member disposed between a portion of said closure and said first sealing member, said second sealing member resiliently pressing said first sealing member against said seat and being covered by said first sealing member on the pressure-impacted side, said first sealing member being formed from an annulus of plastic material, the first sealing member having an inner peripheral portion engaging the closure at the pressure-impacted side to isolate the second sealing member from the sprinkler fluid in the passage, and the closure having an annular, outwardly facing surface adjacent the second sealing member, and a clamping ring embracing the closure and the inner peripheral portion of the first sealing member.

* * * * *